United States Patent [19]

Leiendecker et al.

[11] 4,445,227

[45] Apr. 24, 1984

[54] LOUDSPEAKER HAVING IMPROVED DIRECTIONAL CHARACTERISTICS

[75] Inventors: David N. Leiendecker, Milford, Mich.; Wayne M. Schott, Concord, Tenn.

[73] Assignee: Magnavox Consumer Electronics Company, New York, N.Y.

[21] Appl. No.: 335,089

[22] Filed: Dec. 28, 1981

[51] Int. Cl.[3] ..... H04R 1/34; H04R 5/02

[52] U.S. Cl. ..... 381/24; 181/155; 181/DIG. 1; 381/90

[58] Field of Search ..... 179/1 E, 1 GA, 180; 181/155, 166, DIG. 1, 199; 381/24, 88, 90, 17

[56] References Cited

U.S. PATENT DOCUMENTS

| | | | |
|---|---|---|---|
| 3,735,336 | 5/1973 | Long | 181/DIG. 1 |
| 3,834,486 | 9/1974 | Tsuge et al. | 181/DIG. 1 |
| 3,862,366 | 1/1975 | Huszty et al. | 179/1 E |
| 4,122,302 | 10/1978 | Bobb | 181/155 X |
| 4,224,469 | 9/1980 | Karson | 179/1 E |
| 4,387,787 | 6/1983 | King | 181/155 |

FOREIGN PATENT DOCUMENTS

| | | | |
|---|---|---|---|
| 52-15301 | 2/1977 | Japan | 179/1 GA |
| 978781 | 12/1964 | United Kingdom | 179/1 GA |

*Primary Examiner*—A. D. Pellinen

*Attorney, Agent, or Firm*—Pitts, Ruderman & Kesterson

[57] ABSTRACT

A loudspeaker system (10) having improved directional and frequency response characteristics for use in connection with a sound system having at least two speakers such as a stereo system which is provided. The loudspeaker system includes a driver (14) for low frequencies and/or a full range of frequencies. This driver includes an electroacoustic transducer unit and a sound radiating face having a dustcap (16) and a diaphragm (36). A dispersion control member (34) is positioned at a preselected location such that it overlays a preselected portion of the sound radiating face of the speaker to enhance its directional characteristics. In this connection, the dispersion control member (34) comprises a layer of acoustical, semi-transparent foam having a preselected cross-sectional outline which preferably terminates in one substantially straight edge (38). This member (34) is positioned such that its edge (38) is substantially aligned with the imaginary vertical center line of the sound radiating face thereby expanding the area of stereo imagery such that a listener can be positioned at various locations within the area in front of the speakers and still enjoy the full stereo effect.

11 Claims, 7 Drawing Figures

LOUDSPEAKER HAVING IMPROVED DIRECTIONAL CHARACTERISTICS

DESCRIPTION

1. Technical Field

This invention relates generally to loudspeakers, and is particularly concerned with a loudspeaker in which the directional characteristics of the low frequency driver and/or full range driver are modified to expand the area of stereo imaging. A loudspeaker constructed in accordance with the present invention includes a dispersion control member which comprises a layer of acoustical semi-transparent foam which is positioned over a portion of the sound radiating face of the speaker.

2. Background Art

In typical stereo system setups, the speakers are positioned on a line and preferably face toward a point as the perpendicular bisector of the line upon which the speakers are positioned. When a listener is situated on the perpendicular bisector of the line upon which the speakers are positioned, the full, flat frequency response of the sound radiated by the speakers is perceived. At a location proximate one speaker, the sound pressure level is greater than the more distant speaker, and accordingly, the stereo effect produced by the system for a listener at that location is reduced, due to the sound unbalance. Similarly, as a listener moves to locations closer the opposite speaker, the same sound unbalance would occur, thereby reducing the area within which the stereo image is produced.

Heretofore, expansion of the area within which the stereo image is produced has been attempted with large reflectors or focusers and/or with multiple stereo pairs of speakers. These systems have typically been large and expensive to manufacture. Moreover, the setup itself can be complex and time consuming inasmuch as the components positioning can be interdependent and critical to the stereo image created during operation of the system. One example of a prior art system is disclosed in U.S. Pat. No. 3,759,345.

The loudspeaker of the present invention produces controlled nonsymmetrical dispersion which expands the area of stereo imaging and thereby allows the listener to move with greater freedom or listen from various locations in an expanded area in front of the speakers while still enjoying the full stereo effect of the system. Thus, it is an object of the present invention to provide a loudspeaker which gives the listener an illusion of stereo imaging at almost any position in front of the loud speakers.

It is another object of the present invention to provide a stereo speaker in which the higher frequencies which determine the stereo panorama from both speakers are heard at equal loudness at areas in front of the speakers in which the mid and high frequencies are attenuated as when the listener is closer to one speaker than the other.

Yet, another object of the present invention is to provide a loud speaker having enhanced stereo imaging without substantially increasing the complexity or the expense of the manufacturing process.

Another object of the invention is to provide a loudspeaker having a dispersion control member which comprises a layer of acoustical, semi-transparent foam positioned at a preselected location on the sound radiating face of the speaker.

Still another object of the present invention is to provide a compact speaker which can be used in a system having two speaker cabinets to produce an area of expanded stereo imaging.

A further object of the invention is to provide a speaker having a noncritical construction which can be readily mass produced while maintaining quality.

DISCLOSURE OF THE INVENTION

Other objects and advantages will in part be obvious and will in part appear hereinafter, and will be accomplished by the present invention which provides a loudspeaker for expanding the area of stereo imaging. The loudspeaker includes a low frequency and/or full range driver and an electroacoustic transducer unit with a sound radiating face having a baffle and a diaphragm. The sound radiating face is substantially symmetrical with approximately one-half of its area lying on opposite sides of an imaginary vertical center line. A dispersion control member is provided which comprises a layer of acoustical, semi-transparent foam having a preselected cross sectional outline. This dispersion control member preferably terminates in one substantially straight edge and is positioned for overlaying the sound radiating face such that one edge of the dispersion control member is substantially aligned with the imaginary vertical center of the line of the sound radiating face.

BRIEF DESCRIPTION OF THE DRAWINGS

The above-mentioned features of the present invention will be more clearly understood from the consideration of the following description taken together with the accompanying drawings in which.

BEST MODE FOR CARRYING OUT THE INVENTION

Figure 1:
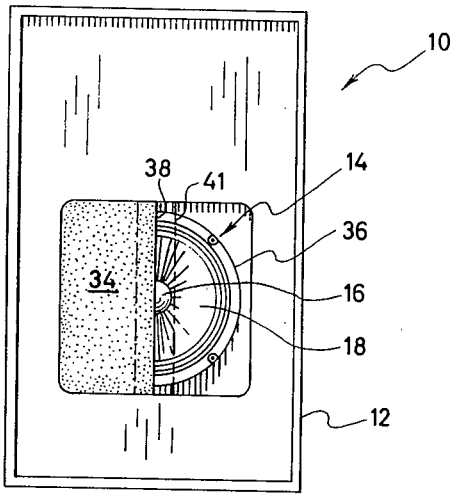
FIG. 1 is a front elevation view of a loudspeaker having a dispersion control member for expanding the area of stereo imaging and constructed in accordance with various features of the present invention.

Referring now to the drawings, a loudspeaker system constructed in accordance with various features of the invention is illustrated generally at 10 in FIG. 1. This loudspeaker is particularly suitable for use in connection with stereo and/or quadraphonic sound systems. More specifically, the loudspeaker system includes a cabinet 12 which houses and mounts a woofer (low frequency driver) and/or a full range driver indicated generally at 14. This driver 14 is of conventional design and includes an electroacoustical transducer unit having a dust cap 16 which keeps dust and particles from getting into the voice coil area. A diaphragm 18 is of conventional design and comprises a membrane which produces audio frequency vibrations.

Figure 2A:
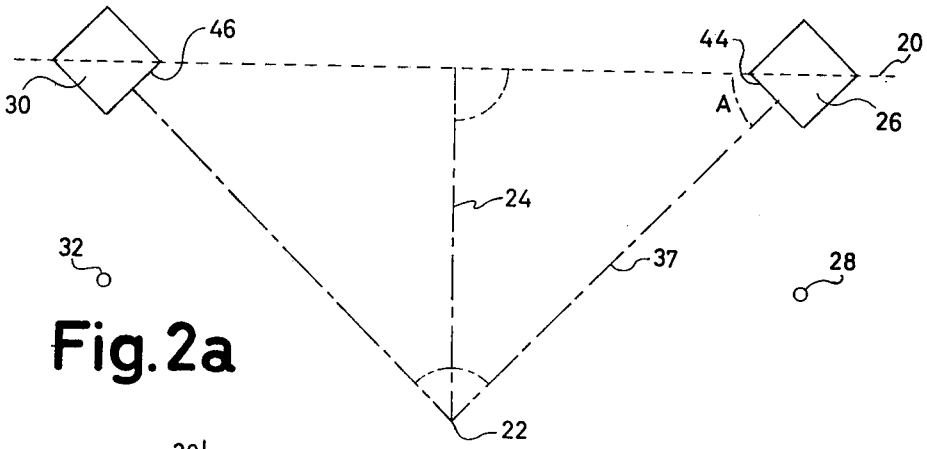
FIG. 2A depicts certain features of a typical stereo system setup and exemplary locations at which the stereo imaging is normally attenuated.

In a typical stereo system setup, the speakers are preferably positioned on a line such as the line indicated at 20 in FIG. 2A and face toward a point 22 on the perpendicular bisector 24 of the line on which the speakers are positioned. When a listener is situated on the perpendicular bisector, the full, frequency performance of both speakers which generates the stereo effect is perceived. As a listener moves toward one of the speakers such as the speaker 26 as by moving to a location generally indicated at 28, the sound pressure level from speaker 26 predominates over speaker 30 because of the differential of listener to speaker distance. More specifically, the medium and high frequencies of speaker 30 are attenuated at location 28. Similarly, in the event a listener moves to a location such as the location indicated at point 32, the mid and high frequencies of the speaker 26 are attenuated and accordingly the stereo imaging is reduced.

In order to expand the area of stereo imaging, a dispersion control member 34 is positioned at a preselected location such that it overlays a selected portion of the sound radiating face outlined by the edge 36 of the diaphragm in the illustrated embodiment in FIG. 1. This dispersion control member in the preferred embodiment comprises a layer of acoustically, semi-transparent foam having a preselected cross-sectional outline. Preferably, the dispersion control member 34 comprises a polyester polyurethane layer which is approximately sixty percent open. It is normally about one-eighth to one-fourth inch thick. In the illustrated embodiment, the outline is substantially rectangular and terminates in a substantially straight edge 38. This edge 38 is positioned as by securing its perimeter to the cabinet or speaker supports for overlaying the sound radiation face of the speaker such that the edge 38 of the dispersion control member is substantially aligned with the imaginary vertical center line of the sound radiating face in the preferred embodiment. The dispersion control member is interposed between the sound radiating face and the grill cover of a conventional speaker, and it has been found that this placement of the layer of acoustical transparent foam over approximately one-half of the sound radiating face of the woofer and/or a full range driver expands the area of stereo imaging. The member 34 defines a perimeter which is secured as with staples, glue or the like to the cabinet and/or speaker supports.

Figure 2B:
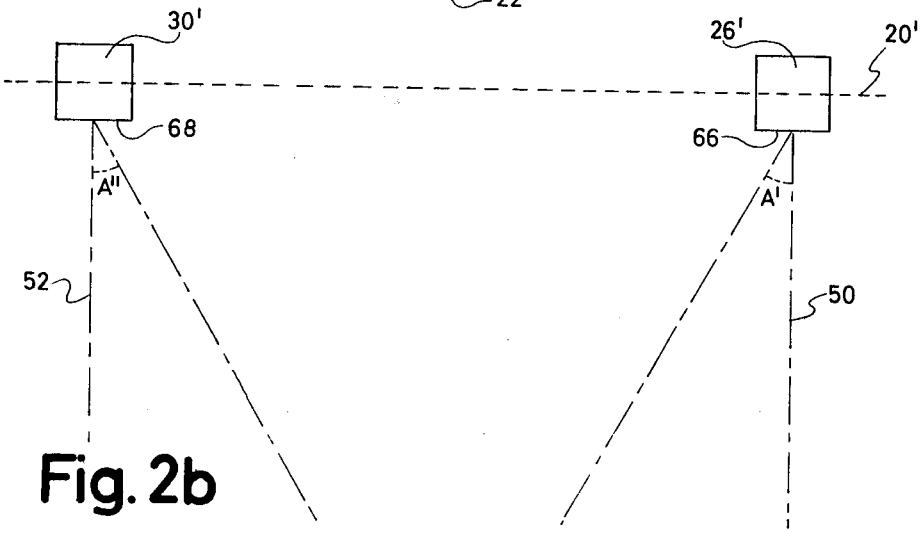
FIG. 2B illustrates the preferred setup of a stereo system in which the speakers incorporate dispersion control members on their inboard sides, which are the juxtaposed sides in the illustration.

FIG. 2B illustrates the placement of the speakers 26' and 30' in a system incorporating dispersion control members constructed in accordance with various features of the present invention. More specifically, these speakers 26' and 30' are preferably positioned on a line 20' and face a direction such that the baffle axes 50 and 52, respectively, are substantially perpendicular with the line 20' upon which the speakers are positioned. Preferably, the dispersion control members for each speaker 26' and 30' are placed on the side of the speaker closest to the other system speaker which is commonly referred to as the inboard side. The sound off axis on the foam side of the sound radiating face, that is, the sound pressure in the area defined by the angles A' and A" in FIG. 2B is louder than the sound pressure off axis on the side having no foam or on the outboard side. It will be noted that these angles A' and A" begin with the baffle axes 50 and 52, for speakers 26' and 30', respectively, which are perpendicular to the sound radiating face of each of the speakers. Thus, the shape of the area into which the sound pressure is radiated by a woofer or full range driver can be controlled. Moreover, this feature can be used in automatic stereo balancing systems.

While the member 34 overlays approximately one-half of the sound radiating face of each speaker in the preferred embodiment, satisfactory results can be achieved by having the edge 38 positioned at a location such as 41 in FIG. 1 such that more than one-half of sound radiating face is covered. Moreover, slightly less than one-half of the sound radiating face can be covered by the member 34.

Figure 3:
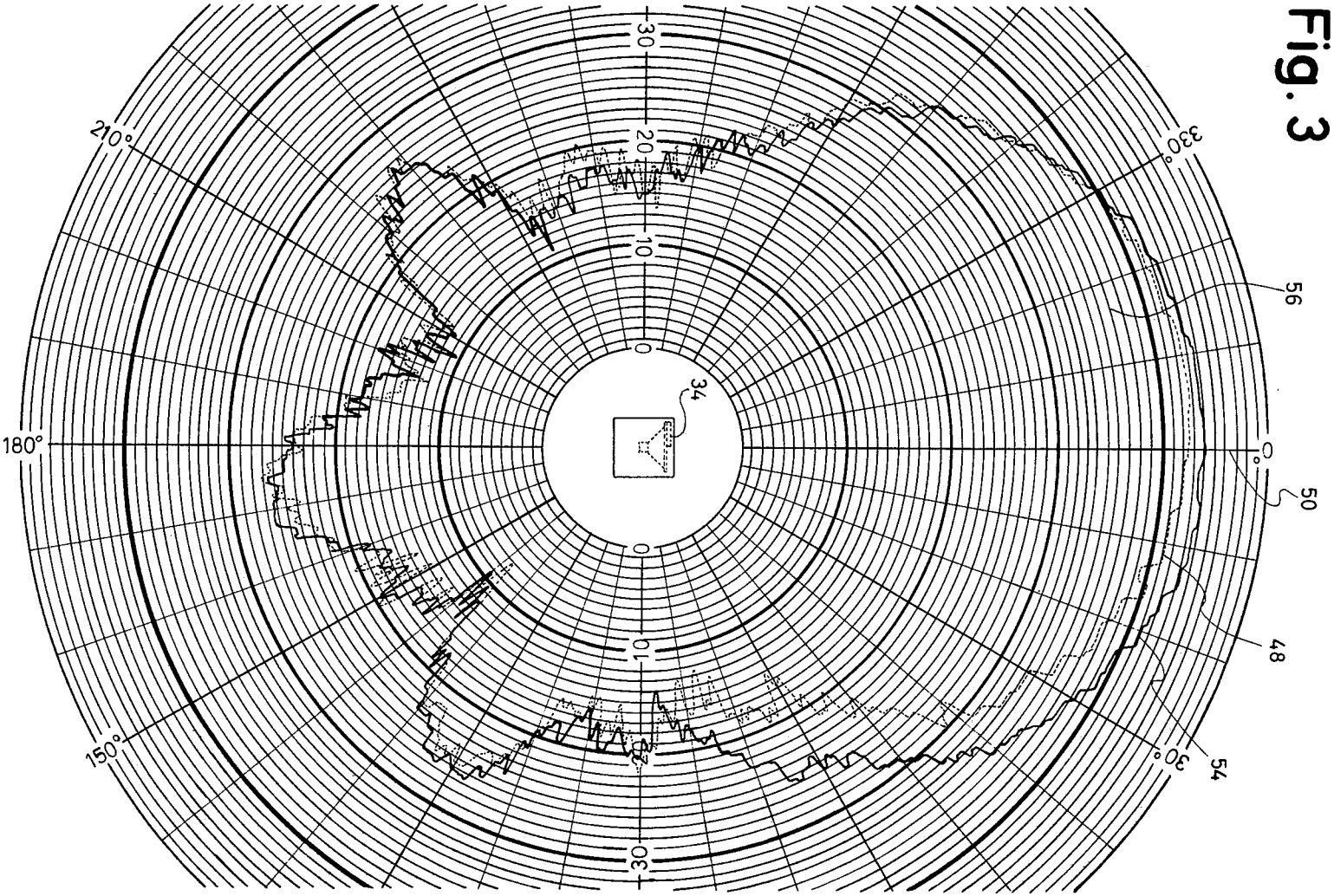
FIG. 3 illustrates certain of the directional characteristics of a speaker constructed in accordance with the present invention compared with a prior art speaker.

FIG. 3 illustrates in polar coordinates, the radiation pattern of the sound pressure of a typical speaker with the zero degree axis 50 depicting the baffle axis or the center line of the driver facing in the direction of the principle radiation. The curve 48 in FIG. 3 illustrates the sound pressure pattern subsequent to modification of the speaker in accordance to various features of the present invention. The curve 54 illustrates the sound pressure pattern of a conventional speaker prior to its being modified by the present invention. It will be recognized that the sound pressure pattern itself is altered by the addition of the dispersion control member, and more specifically shifted toward the inboard side 56 of the baffle axis (axis 50 in FIG. 2B for speaker 26').

Figure 4A:
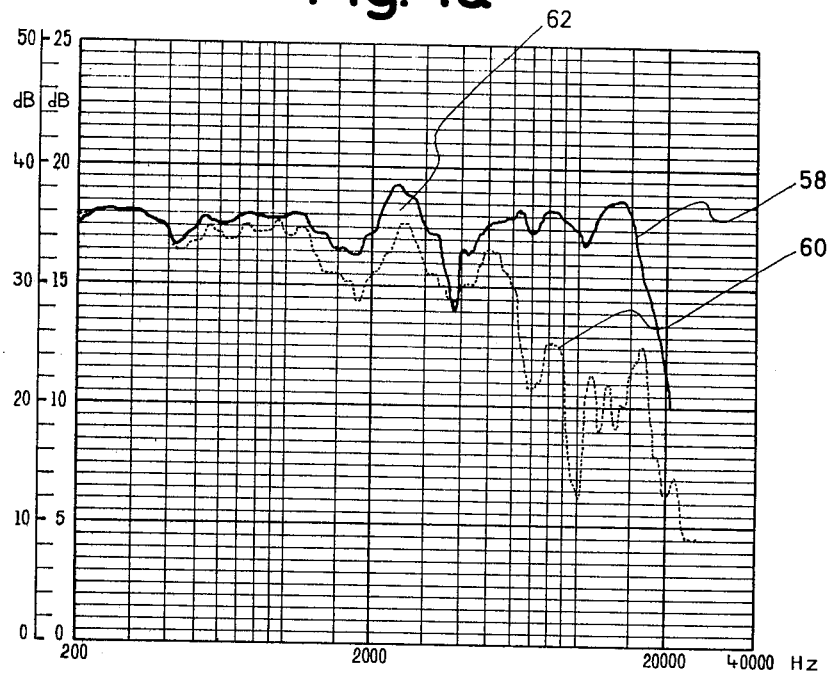
FIGS. 4A and 4B illustrate the frequency response of a speaker which is a two-way system and a full range driver, respectively, modified by a dispersion control member constructed in accordance with the present invention.

FIG. 4A illustrates the frequency versus amplitude response of two-way speaker systems having a woofer and tweeter combination. It will be noted that frequency range between approximately 1000–2500 Hz is affected by the dispersion control member. More specifically, in the desired direction, that is, on the inboard side of the baffle axis or in the direction of a listener, there is a 3–4 db greater output of a speaker incorporating a dispersion control member of the present invention which is illustrated by curve 58, than on the outboard side which is illustrated by curve 60. The off axis measurements are taken along a 30° axis in the inboard and outboard (off axis) direction for purposes of illustration. For example, in FIG. 2B, the 30° off axis measurements in the inboard direction would be along an axis where the angle A' equals 30° . Since the outboard measurement depicts the response in the direction with the benefit of the dispersion control member, the area 62 between these curves in FIG. 4A depicts the enhancement occasioned by the utilization of this member.

Figure 4B:
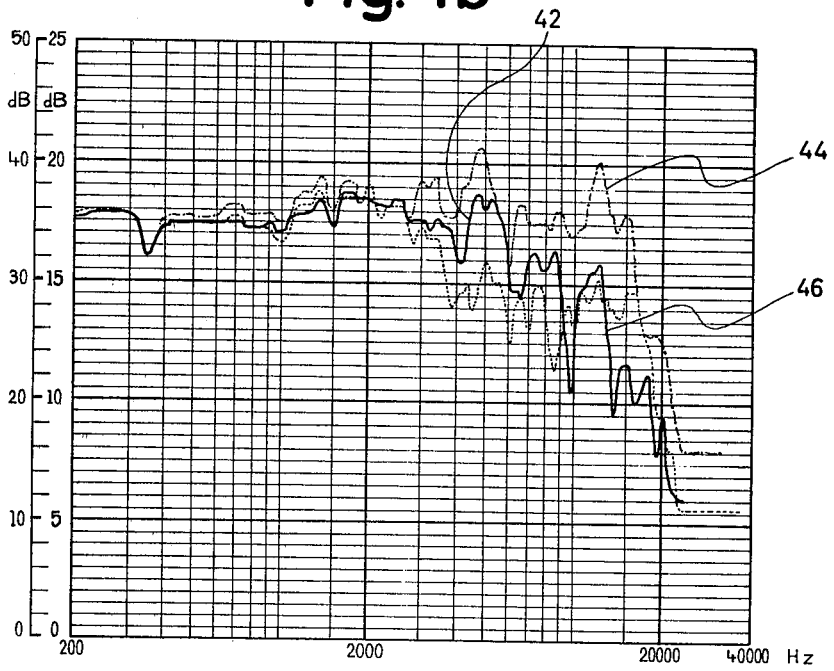

FIG. 4B illustrates the frequency versus amplitude response of a speaker system having a full range driver. The baffle axis curve 44 is compared with the 30° inboard curve 42 and 30° outboard curve 46. Hence, most of the sound pressure is radiated on the baffle axis, but the baffle axis is not being affected by the sound dispersion member. Thus, there is more sound directed toward the center of the room, that is, in the direction of the listener, and less toward the outer part or periphery of the room. It will be noted that in the higher frequencies, between approximately 3000–9000 Hz, the output of the speaker in the inboard direction is improved.

It has been found that the placement of the dispersion control member 34 on the inboard side of the speaker causes sound which is radiated around the member to favor the inboard side of the speaker. Accordingly, the dispersion control members are preferably positioned on the juxtaposed or inboard sides of the speakers at the locations indicated by 66 and 68 on the speakers 26′ and 30′, respectively (see FIG. 2B).

Figure 5:
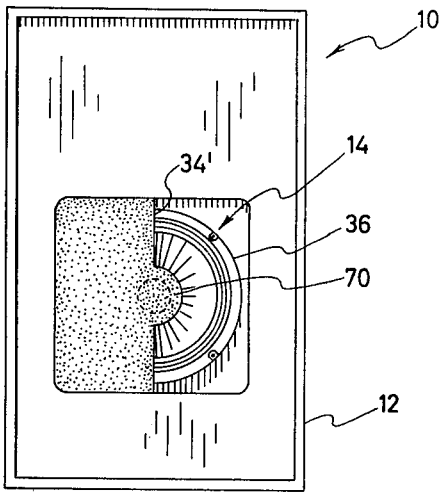
FIG. 5 depicts a loudspeaker having a high frequency beam director which is used in combination with the embodiment illustrated in FIG. 1.

A further feature which can be incorporated in the present invention is the provision of a dispersion control member 34′ which includes a portion 70 illustrated in FIG. 5 that is positioned over the center of the driver to increase the effects of the high frequency beaming in the desired direction. More specifically, the high frequencies beam straight outwardly from this area and the additional foam would direct more of the high frequencies towards the inboard side and alleviate the problem of high frequency beaming on the speaker axis that can deleteriously affect the stereo imaging.

From the foregoing detailed description, it will be recognized that a stereo system incorporating features of the present invention will produce an expanded area of stereo imaging. In this connection, the directional characteristics of the speaker systems woofer and the full range driver is altered to generate an illusion of balanced stereo imaging at almost any position in front of the loudspeakers. Moreover, the system is compact and requires only two loudspeaker cabinets. Further, the construction of the speaker is substantially noncritical, thereby allowing mass production and its associated error tolerances without a concommitant loss of quality.

While a preferred embodiment has been shown and described, it will be understood that there is no intent to limit the invention by such disclosure, but rather it is intended to cover all modifications and alternate constructions following within the spirit and scope of the invention as defined in the appended claims.

We claim:

1. A loudspeaker having improved directional and frequency characteristics for use in a sound system such as a stereo system having at least two speakers, said loudspeaker having an inboard and outboard side and comprising:

a driver for low frequencies and/or a full range of frequencies, said driver having a central portion and including an electroacoustic transducer unit and a sound radiating face including a baffle and a diaphragm, said sound radiating face being substantially symmetrical and defining an imaginary vertical center line; and a dispersion control member comprising a layer of acoustically semi-transparent foam having a preselected cross-sectional outline, said dispersion control member being positioned on the inboard side of said speaker for overlaying said sound radiating face whereby said dispersion control member covers a preselected horizontal portion of said sound radiating face of said speaker.

2. The loudspeaker of claim 1 wherein said dispersion control member comprises a layer of polyester polyurethane foam having a preselected geometrical configuration terminating in at least one substantially straight edge, whereby said straight edge is positioned such that said straight edge is substantially aligned with said imaginary vertical center line of said sound radiating face.

3. The loudspeaker of claim 1 wherein said dispersion control member is polyester polyurethane foam and has a thickness of approximately one-fourth to approximately one-eighth inch and has an open porosity of approximately 60 percent.

4. The loudspeaker of claim 1 wherein said dispersion control member defines a perimeter which is secured to said loudspeaker by suitable securing means.

5. The loudspeaker of claim 4 wherein said securing means comprises staples.

6. The loudspeaker of claim 1 wherein said dispersion control member defines a preselected geometric configuration and terminates in one vertical substantially straight edge wherein said straight edge is positioned such that said dispersion control member overlays more than fifty percent of said sound radiating face.

7. The loudspeaker of claim 1 wherein said dispersion control member defines a preselected geometric configuration and terminates in one vertical substantially straight edge wherein said straight edge is positioned such that said dispersion control member covers less than one-half of said sound radiating face.

8. The loudspeaker of claim 1 wherein said loudspeaker is used in combination with another similarly contructed loudspeaker, each of said speakers being positioned at spaced locations along a first line and facing toward a point on a bisector line substantially perpendicular to said first line, each of said speakers including a dispersion control member positioned on said inboard side of the speaker to which said dispersion control member is attached, each of said dispersion control members having a vertical substantially straight edge being positioned such that said substantially straight edge of said dispersion control member is substantially aligned with said imaginary vertical center line of said sound radiating face of each loudspeaker.

9. The loudspeaker of claims 1 or 2 wherein said dispersion control member includes a projection portion in the plane of said dispersion control member which is positioned over said central portion of said driver for purposes of increasing the effect of high frequency beaming in the direction of said inboard side.

10. A loudspeaker having improved directional and frequency characteristics for use in a sound system such as a stereo system having at least two speakers, said loudspeaker having an inboard and outboard side, comprising:

a driver for low frequencies and/or a full range of frequencies, said driver having a center portion and including an electroacoustic transducer unit and a sound radiating face including a baffle and a diaphragm, said sound radiating face being substantially symmetrical and defining an imaginary vertical center line; and a dispersion control member comprising a layer of acoustically semi-transparent polyester polyurethane foam having an open porosity of approximately 60 percent, said dispersion control member having a preselected cross-sectional outline and terminating in one vertical substantially straight edge, said dispersion control member being positioned for overlaying said sound radiating face such that said substantially straight edge of said dispersion control member is substantially aligned with said imaginary vertical center line of said sound radiating face whereby said dispersion control member covers approximately one-half of said sound radiating face of said speaker.

11. The loudspeaker of claim 10 including an acoustically semi-transparent projection to said dispersion control member extending from said substantially straight edge and positioned over said center portion of said driver for purposes of increasing the effect of high frequency beaming in the direction of said inboard side.

* * * * *